US008651529B2

(12) United States Patent
Yair

(10) Patent No.: US 8,651,529 B2
(45) Date of Patent: Feb. 18, 2014

(54) INTEGRABLE BOOKSTAND

(76) Inventor: Eran Yair, Hertzelia (IL)

( * ) Notice: Subject to any disclaimer, the term of this patent is extended or adjusted under 35 U.S.C. 154(b) by 347 days.

(21) Appl. No.: 13/095,923

(22) Filed: Apr. 28, 2011

(65) Prior Publication Data

US 2012/0274058 A1 Nov. 1, 2012

(51) Int. Cl.

| | |
|---|---|
| ***A47B 23/00*** | (2006.01) |
| ***B42D 3/00*** | (2006.01) |
| ***A47G 1/24*** | (2006.01) |
| ***A47B 97/04*** | (2006.01) |

(52) U.S. Cl.

USPC ..... 281/33; 281/36; 281/29; 248/455; 248/447

(58) Field of Classification Search

USPC ..... 281/29, 33, 36, 51; 248/441.1, 445

See application file for complete search history.

(56) References Cited

U.S. PATENT DOCUMENTS

| | | | | |
|---|---|---|---|---|
| 1,728,431 | A * | 9/1929 | Mevi | 281/33 |
| 1,957,039 | A * | 5/1934 | Buenger et al. | 281/33 |
| 2005/0001420 | A1* | 1/2005 | Gordon | 281/33 |
| 2011/0049860 | A1* | 3/2011 | Suh | 281/33 |

* cited by examiner

*Primary Examiner* — Kyle Grabowski

(74) *Attorney, Agent, or Firm* — AlphaPatent Associates Ltd.; Daniel J. Swirsky

(57) ABSTRACT

An integrable bookstand adapted to be integrated into a hard back cover of a book is disclosed. The integrable bookstand having a withheld and deployed conformations.

In the withheld conformation the bookstand is coplanar with the hard back cover, rendering the latter storable in tandem between other flat articles.

15 Claims, 6 Drawing Sheets

INTEGRABLE BOOKSTAND

TECHNICAL FIELD

In general, the present invention pertains to the arts of bookstands. In particular, the invention relates to an integral bookstand, having deployed and withheld conformations.

BACKGROUND ART

It is believed that the pertinent state-of-the-art is represented by: U.S. Pat. Nos. 2,375,190, 2,587,316, 4,377,271 and 2,256,513; U.S. patent application Ser. Nos. 2007295677, 2003057343 and 2005012016; GB patent application Ser. No. 872982; German patent application Ser. No. 102007033687; European patent application Ser. No. EP2203314 as well as by international patent applications having publication No. 9813215 and 2007069842.

SUMMARY OF THE INVENTION

There is provided in accordance with embodiments of the present invention an integral bookstand.

There is further provided in accordance with embodiments of the present invention a method of using the integral bookstand.

There is yet further provided in accordance with embodiments of the present invention a method integrating a bookstand into the cover of a book.

There is still yet further provided in accordance with embodiments of the present invention a method conferring a support to a book by an integrable stand.

It should be understood, however, that the eclectically synopsized brief summary supra is not to limit the invention to the particular forms and examples, but on the contrary, is to cover all modifications, equivalents, and alternatives falling within the scope of the invention.

DESCRIPTION OF THE DRAWINGS

The present invention will be understood and appreciated more comprehensively from the following detailed description taken in conjunction with the appended drawings in which.

Figure 1A:
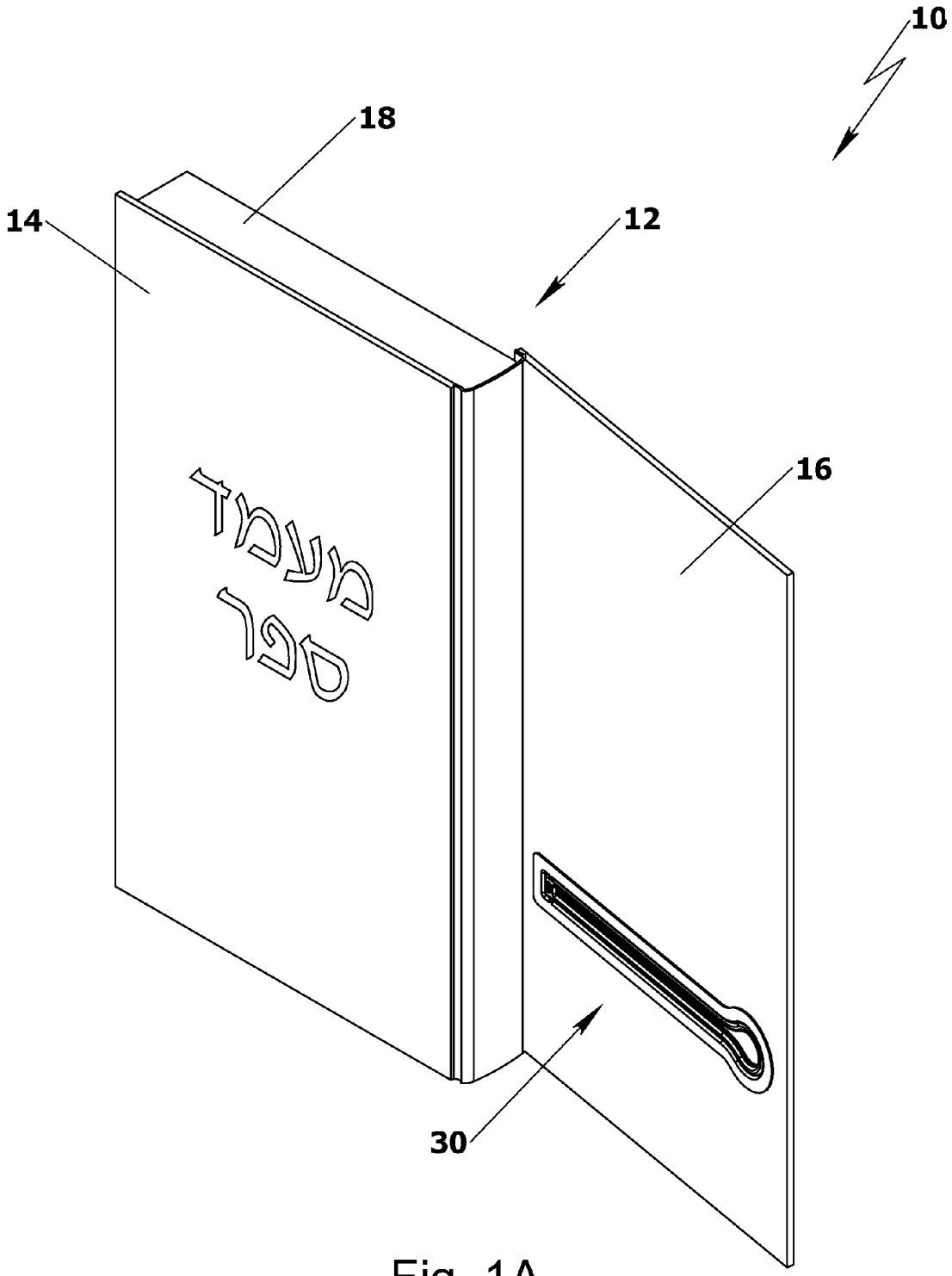
FIG. 1A is an isometric view of an embodiment of the bookstand of the invention integrated into a book cover, in a withheld conformation.
Figure 1B:
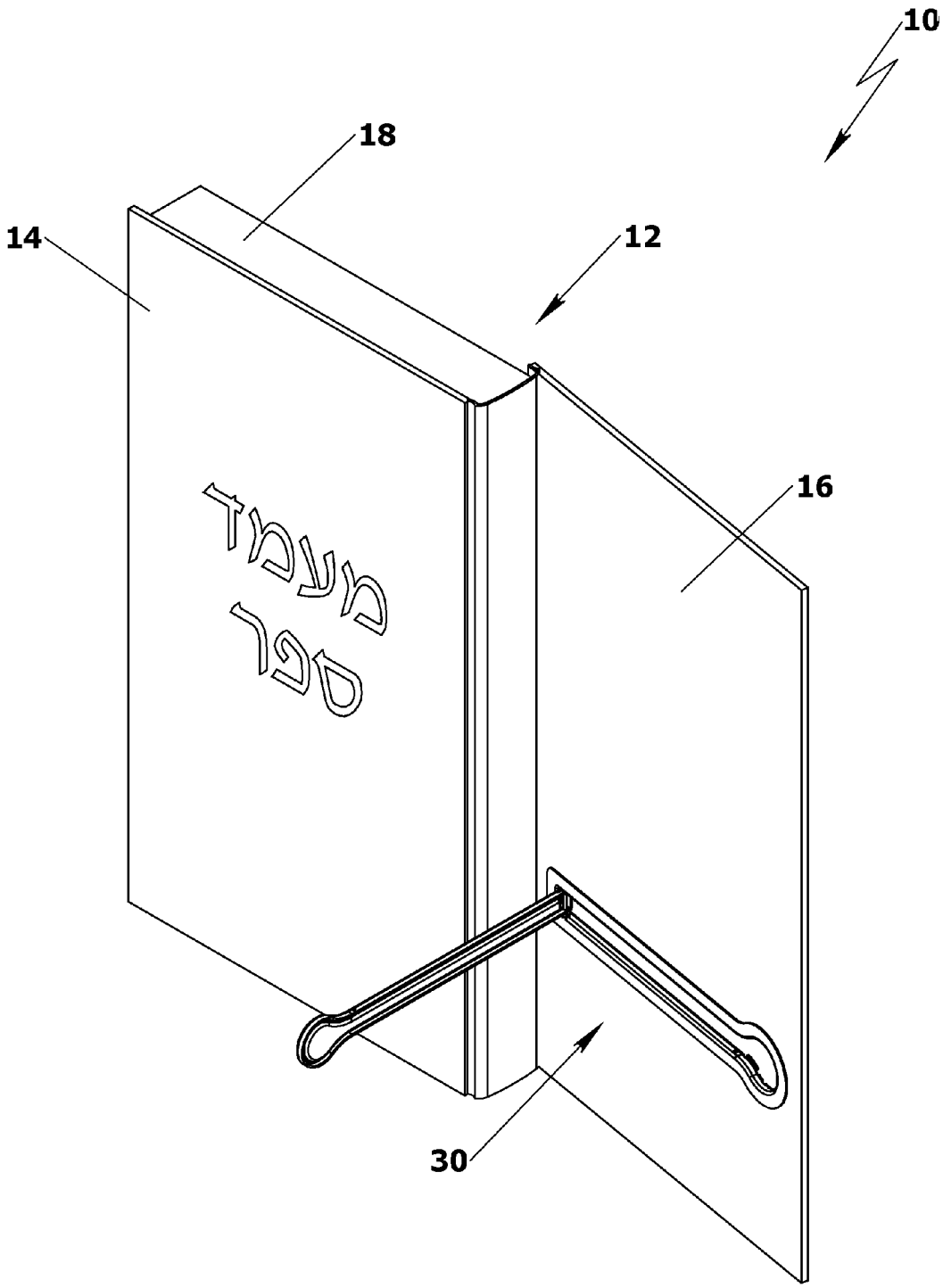
FIG. 1B is an isometric view of an embodiment of the bookstand of the invention shown in FIG. 1, in a deployed conformation.
Figure 1C:
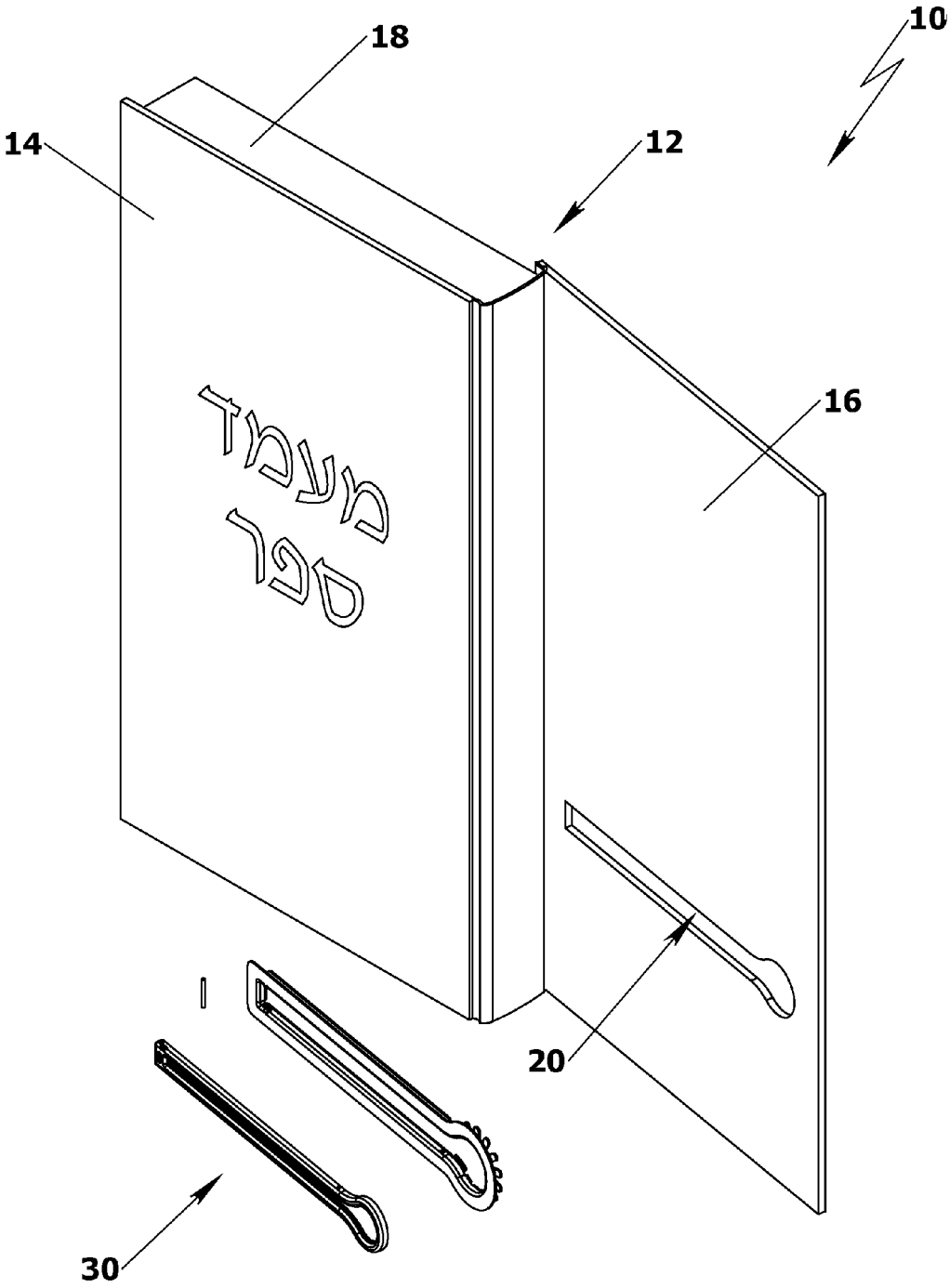
FIG. 1C is an exploded view of an embodiment of the bookstand of the invention shown in FIGS. 1A and 1B.
Figure 2A:
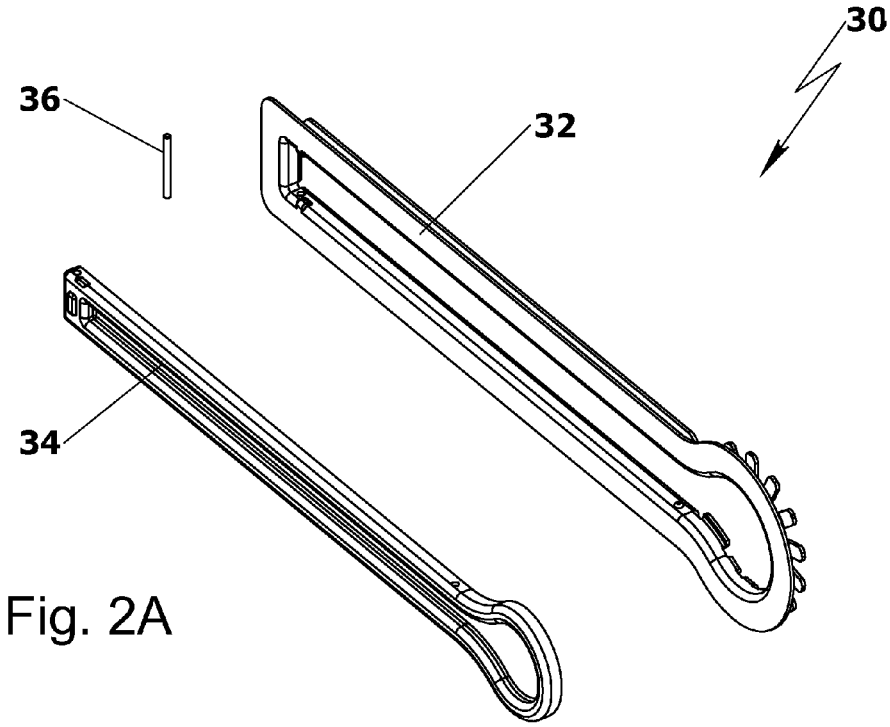
FIG. 2A is an exploded view of an embodiment of the bookstand of the invention.
Figure 2B:
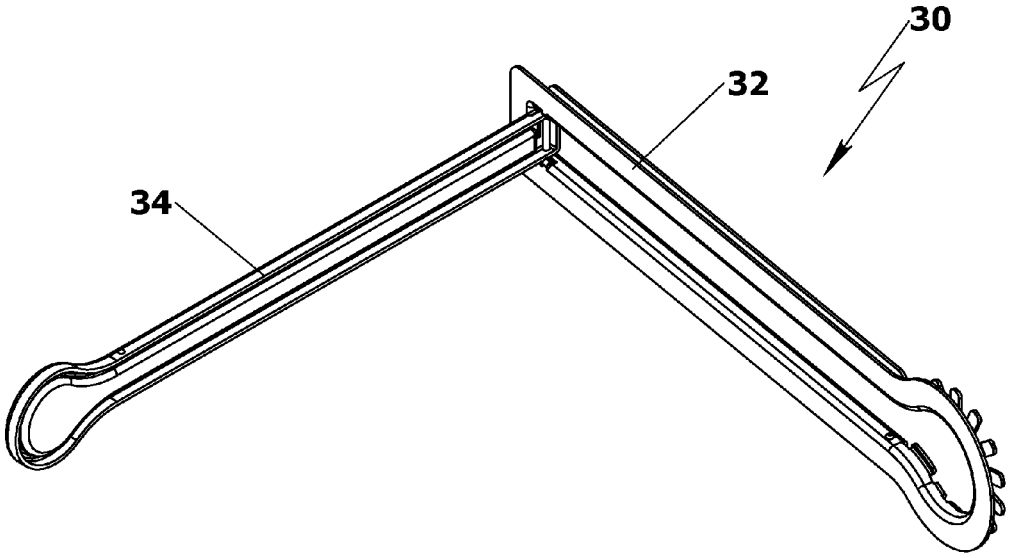
FIG. 2B is an isometric view of an embodiment of the bookstand of the invention, shown in FIG. 2A, in a deployed conformation.
Figure 3A:
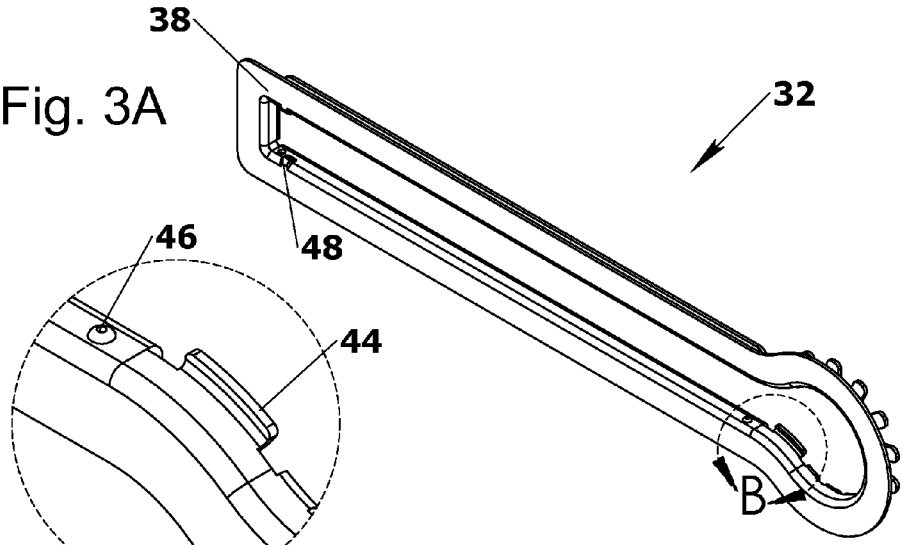
FIG. 3A is an isometric view of the outer frame of the bookstand of the invention.
Figure 3B:
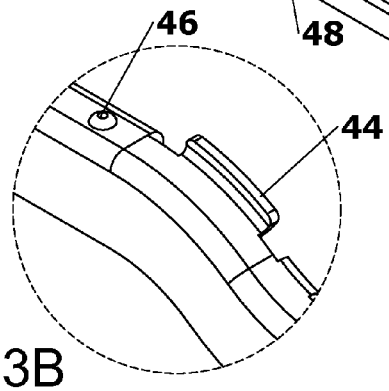
FIG. 3B is an enlarged view of a portion of the outer frame of the bookstand of the invention shown in FIG. 3A.
Figure 3C:
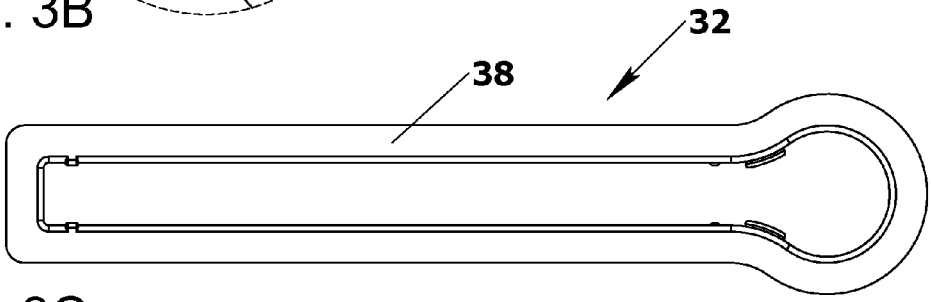
FIG. 3C is a front view of the outer frame of the bookstand shown in FIG. 3A.
Figure 3D:
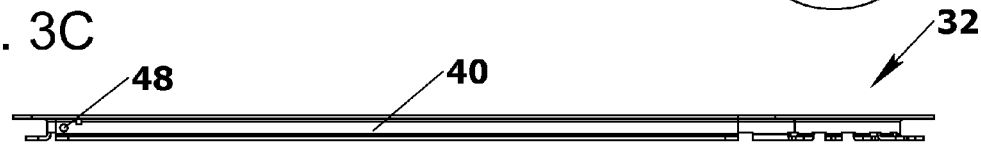
FIG. 3D is a top view of the outer frame of the bookstand shown in FIG. 3A.
Figure 3E:
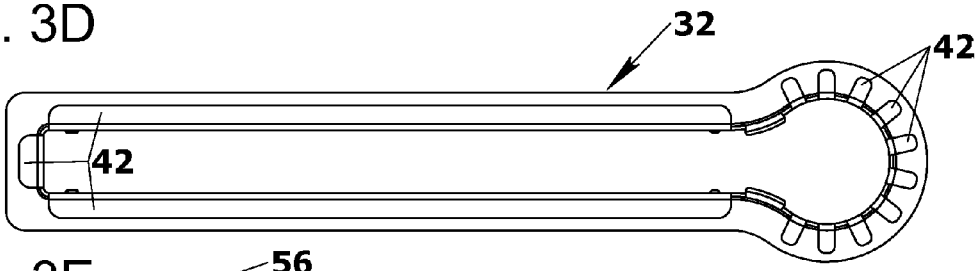
FIG. 3E is a front view of the outer frame of the bookstand shown in FIG. 3A.
Figure 4:
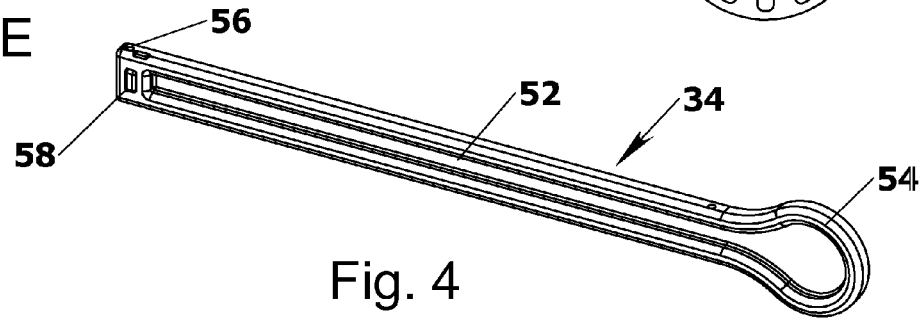
FIG. 4 is an isometric view of the support member of the bookstand of the invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DESCRIPTION OF EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the present invention, reference is now made to FIGS. 1A to 4. Assembly 10 comprises book 12 and integral bookstand mechanism 30. Book 12 comprises front hard cover 14 and back hard cover 16, encompassing book pages 18 therebetween. Back hard cover 16 of book 12 comprises structured aperture 20 adapted to accommodate bookstand mechanism 30. In withheld conformation bookstand mechanism 30 assumes an essentially flat shape, wherein the exterior edges of the components of mechanism 30 are substantially coplanar with the faces of back hard cover 16 of book 12, rendering the latter storable in tandem between other books or flat articles (not shown), in withheld conformation of mechanism 30.

Bookstand mechanism 30 comprises integrable frame 32, disposed within structured aperture 20 in back cover 16 of book 12. Support member 34 is pivotally mounted within integrable frame 32, capable of restricted rotation about pivot 36. In deployed support member 34 is protracted relatively to integrable frame 32 at a predetermined angle; thereby rendering book 12 stable in an upright orientation upon slightly slanting assembly 10 backwards. Upon slightly slanting assembly 10 backwards, support member 34 is brought towards the surface front cover and back covers, 14 and 16 respectively, of book 12 supported by, thus providing a additional support point and stabilizing assembly 10 in an essentially upright orientation.

Integrable frame 32 comprises exterior peripheral flange portion 38, adjoined vis-à-vis the surface of back cover 16 of book 12. Integrable frame 32 further comprises interbridging portion 40. Interbridging portion 40 of integrable frame 32 is characterized by that the width thereof essentially matches the respective thickness of back cover 16 of book 12, wherein frame 32 is to be integrated. Integrable frame is furnished with a plurality of wings 42, extending from interbridging portion 40 in a bentable manner. Upon insertion of integrable frame 32 into structured aperture 20 in back cover 16 of book 12, wings 42 are outwardly bent, thereby affixing the former in the latter.

Integrable frame 32 comprises stopper element 44, aimed at limiting the rotation of support member 34 beyond the plane of back cover 16 of book 12. Integrable frame 32 further comprises protrusion 46, aimed at affixing support member 34 in an essentially coplanar orientation relatively to integrable frame 32, in withheld conformation of mechanism 30. Integrable frame 32 includes apertures 48, used to accommodate pivot 36.

Support member 34 comprises extended rectangular portion 52 and apically toroidal portion 54. Rectangular portion 42 comprises aperture 56, used to accommodate pivot 36. Apically toroidal portion 54 is placed on the surface front cover and back covers, 14 and 16 respectively, of book 12 supported by, thus providing a additional support point and stabilizing assembly 10 in an essentially upright orientation. Apically toroidal portion 54 is typically large enough to allow conveniently displacing support member 34 from integrable frame 32, by pushing portion 54 by a finger throughout integrable frame 32 from the inner side of back cover 16 of book 12. Support member 34 further comprises protrusion 56, aimed at limiting the rotation of support member 34 beyond a predetermined angle, and recess 56 used to accommodate protrusion 46 of integrable frame 32; thereby affixing support member 34 in an essentially coplanar orientation relatively to integrable frame 32, in withheld conformation of mechanism 30.

BEST MODE FOR PRACTICING AND CARRYING OUT THE INVENTION

Figure 5A:
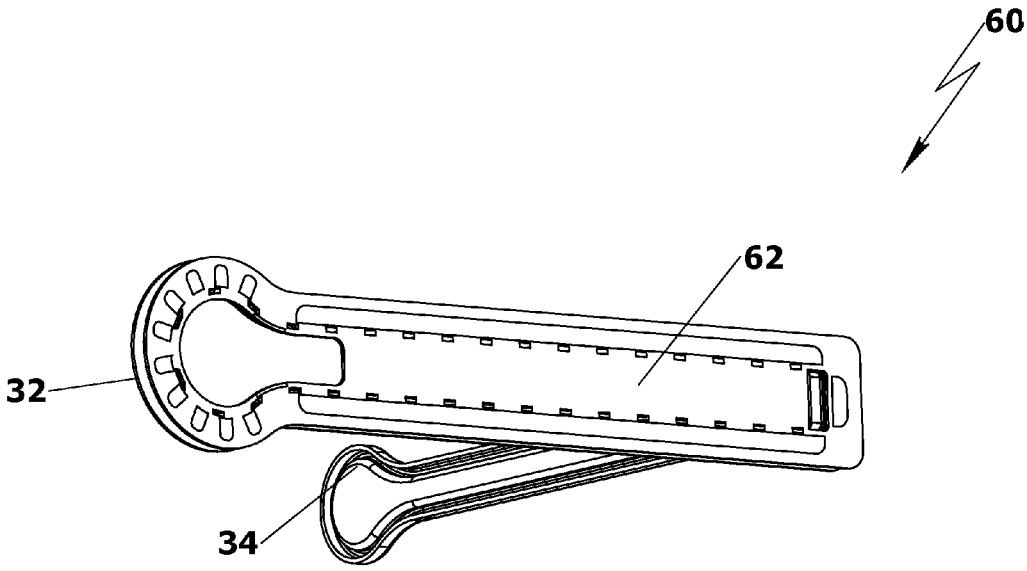
FIG. 5A is a perspective view of a preferred embodiment of the bookstand of the invention.
Figure 5B:
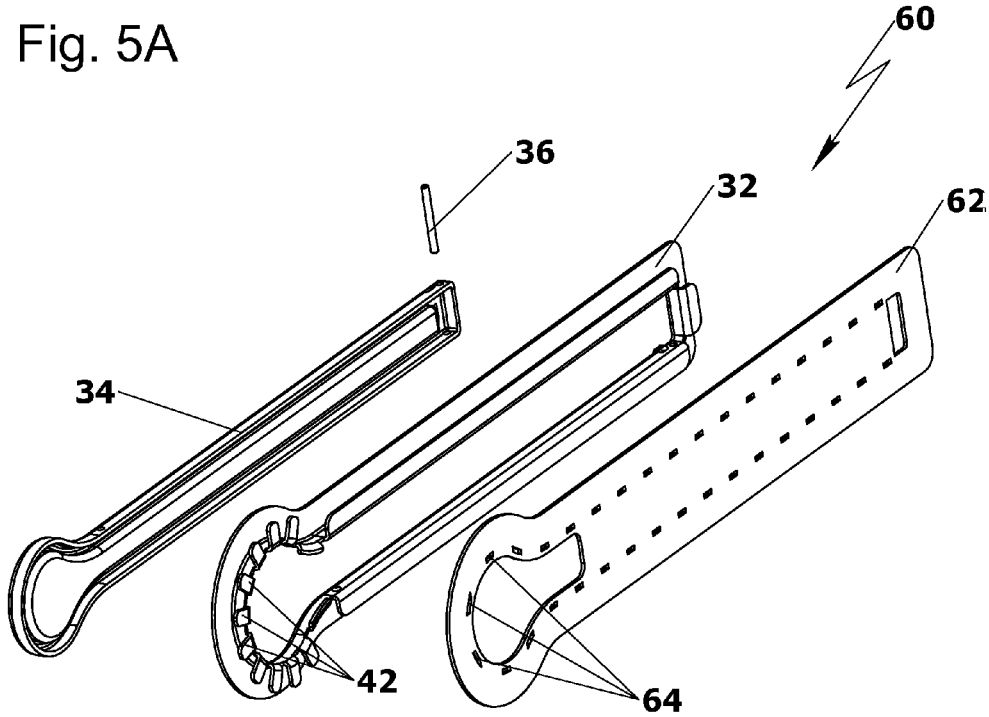
FIG. 5B is an exploded view of a preferred embodiment of the bookstand of the invention shown in FIG. 5A.

In accordance with some preferred embodiments of the present invention, reference is now made to FIGS. 5A to 5B, showing bookstand mechanism 60. Bookstand mechanism 60 comprises integrable frame 32, disposed within structured aperture 20 in back cover 16 of book 12. Support member 34 is pivotally mounted within integrable frame 32, capable of restricted rotation about pivot 36. Bookstand mechanism 60 further comprises insert 62, having a plurality of apertures 64, therein. Apertures 64, respectively match wings 42 extending from interbridging portion 40 integrable frame 32, whereby upon inserting wings 42 into apertures 64, while insert 62 is adjoined vis-à-vis the interior face of back cover 16 of book 12. Thereafter wings 42 are outwardly bent, thereby affixing mechanism 60 within structured aperture 20 in back cover 16 of book 12, in-between insert 62 and peripheral flange portion of integrable frame 32. Insert 62 substantially obstructs the access through the longitudinal rectangular portion of the aperture in integrable frame 32, leaving the apical toroidal portion of the aperture in integrable frame 32 open for an access of a finger, so as to displace support member 34 from the withheld conformation of mechanism 30.

In another preferred embodiment the integrable frame comprises two moieties (not shown). The interbidging portions of the interlock with each other, exemplarily by a snapping arrangement. Each moiety is appended from another side of the hard back cover of a book and thereafter the interbidging portions thereof interlock with each other; thereby affixing the assembled frame integrated within the hard back cover of a book.

In favor of these who shall engage in experimentation guided by this disclosure, the following preferable numerical values are disclosed. The position of the integrable frame within the respective aperture is preferably from about 10% to about 60% along the longitudinal dimension of the book cover. The length of the supporting element is preferably from about 40% to about 95% relatively to the width of the book cover. The maximal angle of the supporting element relatively the book cover or the integrable frame typically ranges from about 70 degrees to about 120 degrees; whereas the preferable angle is about 90 degrees.

It will be appreciated by persons skilled in the art that the present invention is not limited by what has been particularly shown and described herein above. Rather the scope of the invention is defined by the claims which follow:

The invention claimed is:

1. An integrable bookstand and a book having a hard back cover, wherein said hard back cover includes an aperture, said integrable bookstand comprising:

an integrable frame, said frame having
- at least one portion adjoinable to an exterior face of said hard back cover of said book, and
- at least one portion disposable in said respective aperture in said hard back cover of said book; and a support member operationally connected to said integrable frame, said support member having
- an elongated portion pivotally connected to said integrable frame, and
- a terminal portion placeable on a surface supporting said hard back cover of said book, wherein said integrable bookstand is configurable in either of a non-deployed configuration and a deployed configuration, wherein in said non-deployed configuration, said support member is substantially coplanar with said hard back cover of said book, thereby rendering said book storable in tandem between other flat articles, wherein in said deployed configuration, said support member is extended from said integrable frame, whereby upon slightly slanting said book backwards, said terminal portion of said support member is placed onto said surface supporting said hard back cover of said book, thereby providing an additional support point and stabilizing said book in a substantially upright orientation, and wherein said support member is substantially parallel to said surface supporting said hard back cover of said book, thereby rendering said book standable in said substantially upright orientation while said book is closed.

2. The integrable bookstand set forth in claim 1, wherein said support member is pivotally mounted within said integrable frame.

3. The integrable bookstand set forth in claim 2, wherein the rotation of said support member is restricted to a predetermined angle.

4. The integrable bookstand set forth in claim 3, wherein said predetermined angle ranges from about 70 to about 120 degrees.

5. The integrable bookstand set forth in claim 1, further comprising a pivot.

6. The integrable bookstand set forth in claim 1, wherein in said non-deployed configuration said bookstand assumes a substantially flat shape, wherein the exterior edges thereof are substantially coplanar with the faces of said back cover of said book, thereby rendering the book storable in tandem between other flat articles.

7. The integrable bookstand set forth in claim 1, wherein said integrable frame comprises an exterior peripheral flange portion adjoinable to the surface of said back cover of said book.

8. The integrable bookstand set forth in claim 1, wherein said integrable frame is furnished with a plurality of outwardly bendable wings.

9. The integrable bookstand set forth in claim 1, wherein said integrable frame comprises stopper element limiting the rotation of said support member.

10. The integrable bookstand set forth in claim 1, wherein said support member is affixable within said integrable frame.

11. The integrable bookstand set forth in claim 1, wherein said integrable frame further comprises a respectively matching insert, said respectively matching insert having a plurality of apertures respectively accommodating at least one wing of said integrable frame.

12. The integrable bookstand set forth in claim 11, wherein said insert comprises an aperture accessible to a finger for opening said support member.

13. The integrable bookstand set forth in claim 1, wherein the length of said supporting element ranges from about 40% to about 95% relatively to the width of said book cover.

14. An integrable bookstand and book, comprising:

an integrable frame integrated into a hard back cover of the book; and a support member operationally connected to said integrable frame;

wherein said integrable bookstand have non-deployed and deployed configurations, wherein in said non-deployed configuration said support member is substantially coplanar with said hard back cover of said book, thereby rendering said book storable in tandem between other flat articles, wherein in said deployed configuration said support member is extended from said integrable frame, whereby upon slightly slanting said book backwards, said support member is placed onto a surface supporting said covers of said book, providing an additional support point and stabilizing said book in a substantially upright orientation, and wherein said support member is substantially parallel to the surface supporting said hard back cover of said book.

15. The integrable bookstand set forth in claim 14, wherein said integrable frame is integrated into a respective aperture within said hard back cover of said book.

* * * * *